US006585316B2

(12) United States Patent
Kucera

(10) Patent No.: US 6,585,316 B2
(45) Date of Patent: Jul. 1, 2003

(54) BOAT SEAT SYSTEM

(76) Inventor: Rocky A. Kucera, P.O. Box 296, Ranier, MN (US) 56668

( * ) Notice: Subject to any disclaimer, the term of this patent is extended or adjusted under 35 U.S.C. 154(b) by 0 days.

(21) Appl. No.: 09/790,450

(22) Filed: Feb. 21, 2001

(65) Prior Publication Data

US 2002/0145314 A1 Oct. 10, 2002

(51) Int. Cl.[7] ..... A47C 7/62

(52) U.S. Cl. ..... 297/188.06; 297/188.07; 224/275

(58) Field of Search ..... 297/188.06, 188.04, 297/188.01, 188.05, 188.07, 188.2, 217.1, 188.12; 441/126, 127; 224/275; D12/416; 220/503, 504, 493, 486, 495

(56) References Cited

U.S. PATENT DOCUMENTS 2,429,050 A * 10/1947 Decker ..... 297/188.07 X
2,615,563 A * 10/1952 Sundberg et al. ..... 206/541
4,619,623 A * 10/1986 Elverskog ..... 441/126
D389,115 S * 1/1998 Alves et al. ..... D12/416
5,785,427 A * 7/1998 Godshaw ..... 383/4
5,820,210 A * 10/1998 Shipman et al. ..... 297/188.01
5,927,800 A * 7/1999 Stallworth ..... 297/188.08
6,062,416 A * 5/2000 Smillie ..... 220/524
6,152,527 A * 11/2000 McDowell ..... 297/188.04 X
6,216,927 B1 * 4/2001 Meritt ..... 224/275

* cited by examiner

*Primary Examiner*—Peter M. Cuomo
*Assistant Examiner*—Stephen Vu

(57) ABSTRACT

A boat seat system for conveniently storing various items includes a life jacket and fishing tackle without interfering with the operation of the boat seat. The boat seat system includes an upper storage attachable to a back rest of a boat seat, and a lower storage attached to the upper storage for receiving a tackle box. The upper storage has an upper opening for receiving and dispensing a life jacket that is retained within the upper storage by a securing strap. The lower storage includes a pivotally attached door that allows selective enclosure of the tackle box within the lower storage during nonuse of the tackle box. The upper storage preferably includes a rear webbing and a front webbing for providing ventilation of the life jacket.

14 Claims, 9 Drawing Sheets

BOAT SEAT SYSTEM

BACKGROUND OF THE INVENTION

1. Field of the Invention

The present invention relates generally to boat seat devices and more specifically it relates to a boat seat system for conveniently storing various items including a life jacket and fishing tackle without interfering with the operation of the boat seat.

2. Description of the Prior Art

Seats and more particularly boat seats have been in use for years. Typically, a boat seat is attached to a bench or other structure within a boat by a direct connection or swivel connection as is well established in the art. Conventional boat seats provide a bottom support with a back rest attached to the bottom support.

The main problem with boats and boat seats is that there is no convenient location to store the numerous life jackets that must be carried upon the boat. Boaters often times place the life jackets in inconvenient locations that are difficult to reach in an emergency. Some boaters simply leave the life jackets laying upon the hull of the boat thereby sometimes resulting in damage to the life jackets. Another problem with conventional boats and boat seats is that there typically is no convenient location to store items such as fishing tackle. A boater often times must bring a separate tackle box which is prone to tipping over thereby spilling the tackle items contained within. Another problem with using conventional tackle boxes is that the users often times place the tackle boxes upon the hull of the boat thereby possibly creating a dangerous situation for individuals walking about the boat. Various other problems are existing in conventional boats and boat seats which are deemed readily apparent.

Examples of patented seat devices which are illustrative of such prior art include U.S. Pat. No. 4,619,623 to Elverskog; U.S. Pat. No. 358,731 to McAlear; U.S. Pat. No. 94,448 to Simonson; U.S. Pat. No. 5,139,308 to Ziman; U.S. Pat. No. 5,342,109 to Berry et al.; U.S. Pat. No. 5,354,119 to Nicholas; U.S. Pat. No. 5,544,793 to Harrop.

While these devices may be suitable for the particular purpose to which they address, they are not as suitable for conveniently storing various items including a life jacket and fishing tackle without interfering with the operation of the boat seat. Conventional boats and boat seats do not provide for a convenient location for storing fishing related items such as but not limited to tackle and life jackets.

In these respects, the boat seat system according to the present invention substantially departs from the conventional concepts and designs of the prior art, and in so doing provides an apparatus primarily developed for the purpose of conveniently storing various items including a life jacket and fishing tackle without interfering with the operation of the boat seat.

SUMMARY OF THE INVENTION

In view of the foregoing disadvantages inherent in the known types of boats and boat seats now present in the prior art, the present invention provides a new boat seat system construction wherein the same can be utilized for conveniently storing various items including a life jacket and fishing tackle without interfering with the operation of the boat seat.

The general purpose of the present invention, which will be described subsequently in greater detail, is to provide a new boat seat system that has many of the advantages of the boat seats mentioned heretofore and many novel features that result in a new boat seat system which is not anticipated, rendered obvious, suggested, or even implied by any of the prior art boat seats, either alone or in any combination thereof.

To attain this, the present invention generally comprises an upper storage attachable to a back rest of a boat seat, and a lower storage attached to the upper storage for receiving a tackle box. The upper storage has an upper opening for receiving and dispensing a life jacket that is retained within the upper storage by a securing strap. The lower storage includes a pivotally attached door that allows selective enclosure of the tackle box within the lower storage during nonuse of the tackle box. The upper storage preferably includes a rear webbing and a front webbing for providing ventilation of the life jacket.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a boat seat system that will overcome the shortcomings of the prior art devices.

A second object is to provide a boat seat system for conveniently storing various items including a life jacket and fishing tackle without interfering with the operation of the boat seat.

Another object is to provide a boat seat system that provides immediate access to life jackets in the event of an emergency.

An additional object is to provide a boat seat system that provides a safer environment upon a boat for passengers.

A further object is to provide a boat seat system that allows a fisherman to easily access their tackle while sitting with the boat seat.

Another object is to provide a boat seat system that does not interfere with the normal operation of the boat or boat seats.

A further object is to provide a boat seat system that is attachable to various types of boat seats.

Another object is to provide a boat seat system that does not interfere with the folding of a foldable boat seat.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
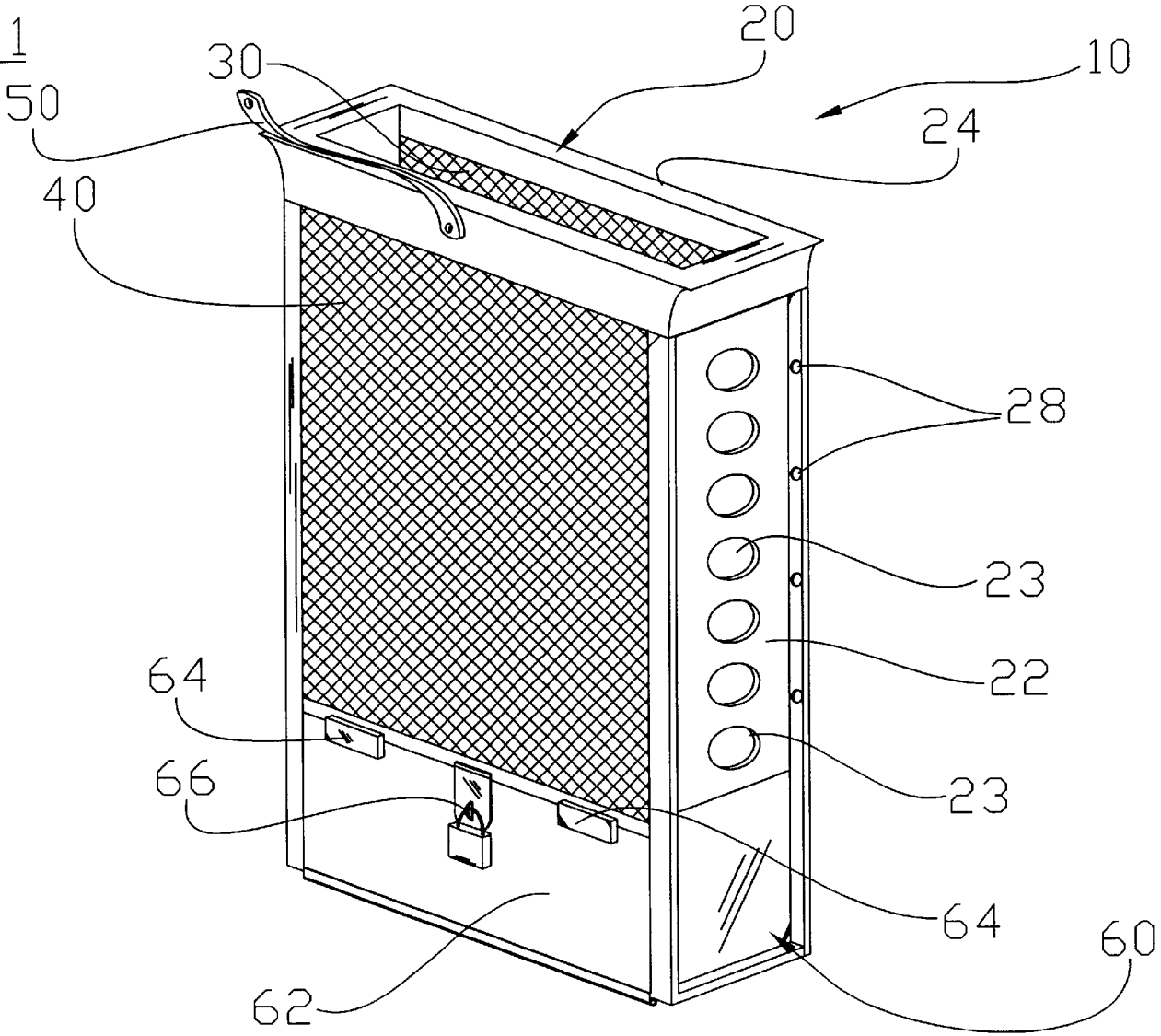
FIG. 1 is an upper perspective view of the present invention.

Turning now descriptively to the drawings, in which similar reference characters denote similar elements throughout the several views, FIGS. 1 through 9 illustrate a boat seat system 10, which comprises an upper storage 20 attachable to a back rest 14 of a boat seat 12, and a lower storage 60 attached to the upper storage 20 for receiving a tackle box 13. The upper storage 20 has an upper opening 24 for receiving and dispensing a life jacket 19 that is retained within the upper storage 20 by a securing strap 50. The lower storage 60 includes a pivotally attached door 62 that allows selective enclosure of the tackle box 13 within the lower storage 60 during nonuse of the tackle box 13. The upper storage 20 preferably includes a rear webbing 30 and a front webbing 40 for providing ventilation of the life jacket 19.

As shown in FIGS. 2 through 6 of the drawings, a conventional boat seat 12 is typically comprised of a bottom support 16 and a back rest 14. The back rest 14 may be nonmovably or movably attached by a hinge 18 or other structure to the bottom support 16 as is well known in the art. The bottom support 16 is typically attached to a bench or other structure within the boat as is also well established in the art.

Figure 2:
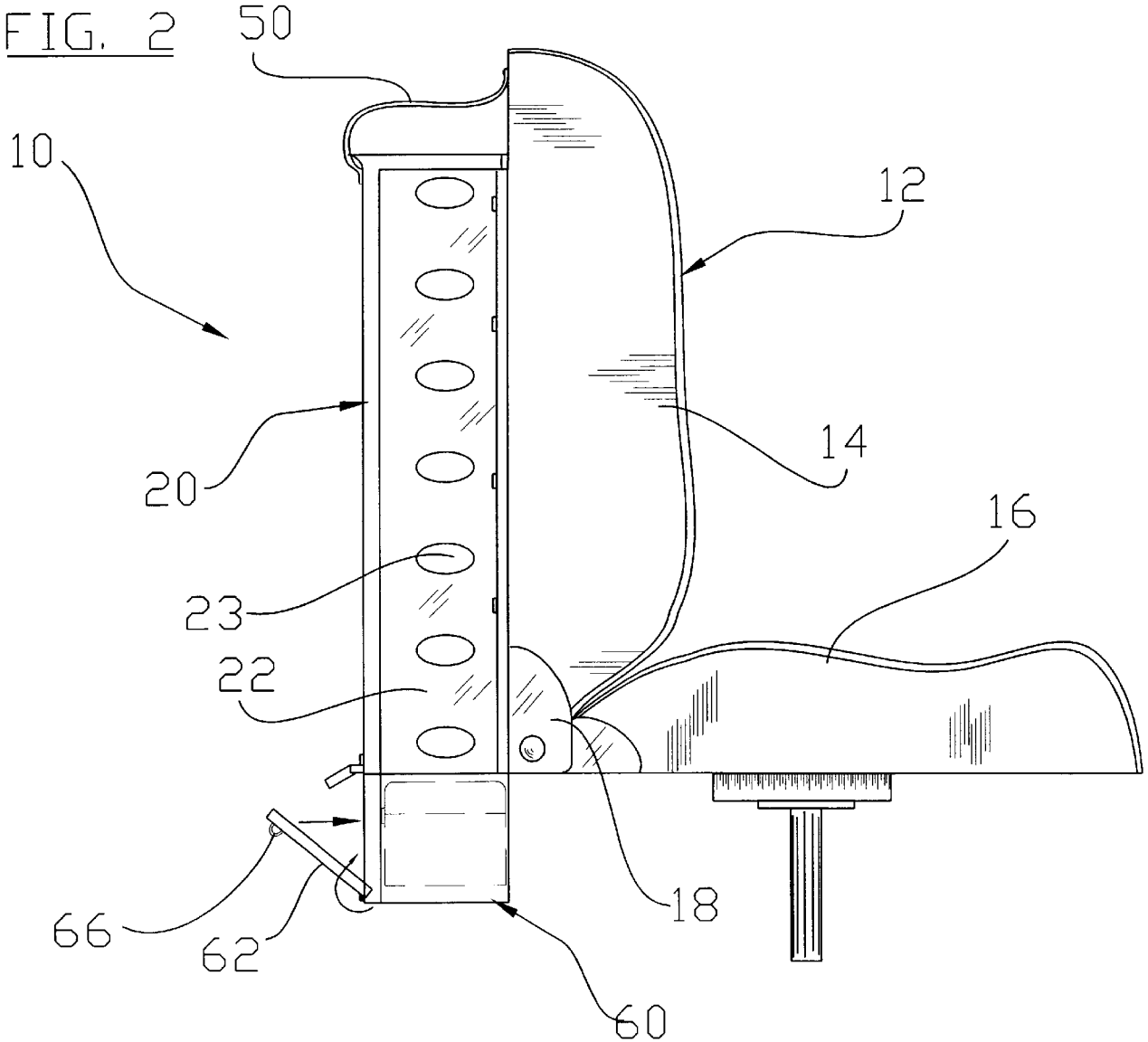
FIG. 2 is a side view of the present invention attached to the back rest of a boat seat.
Figure 3:
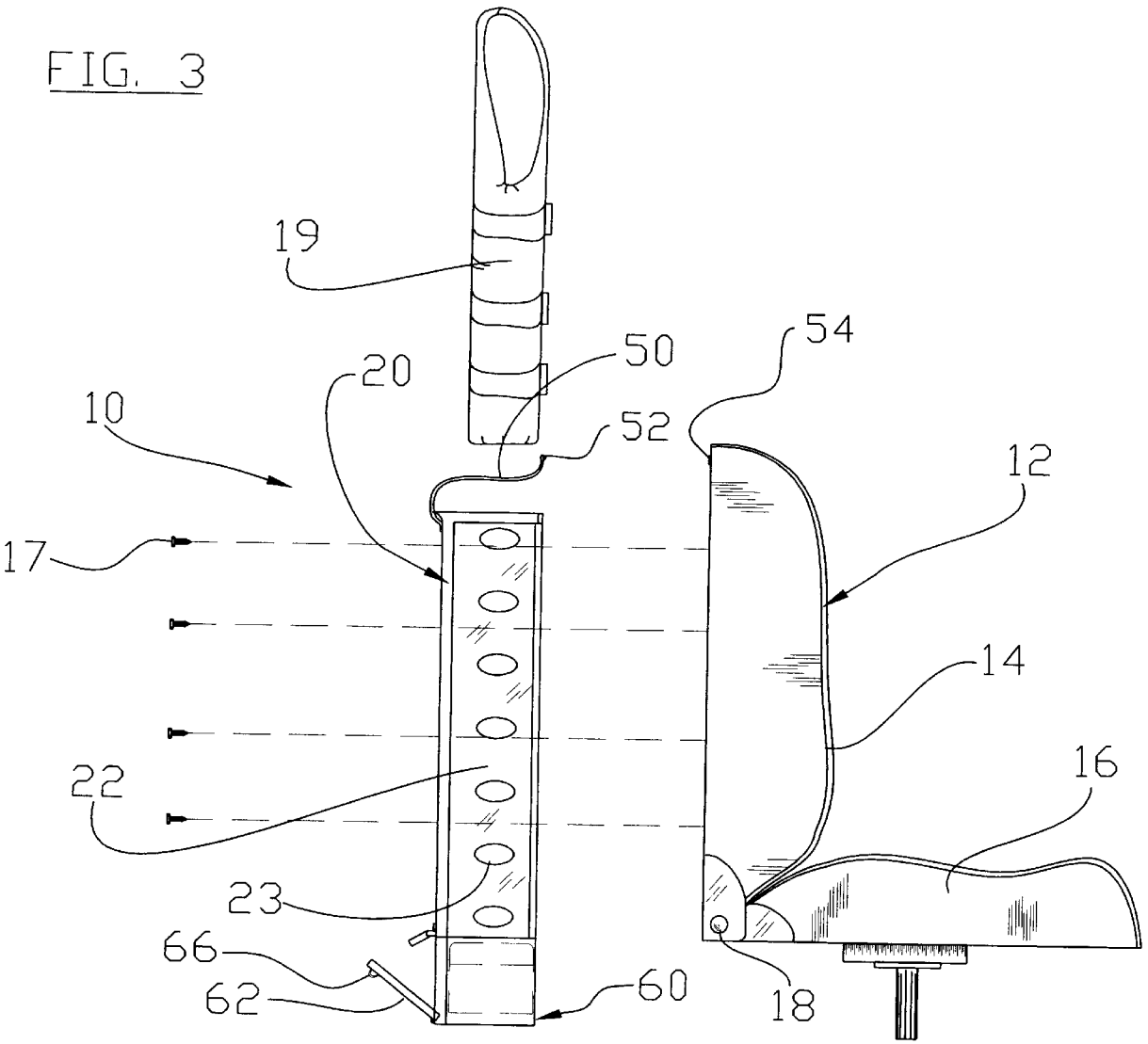
FIG. 3 is an exploded side view of the present invention with respect to the back rest of a boat seat.
Figure 4:
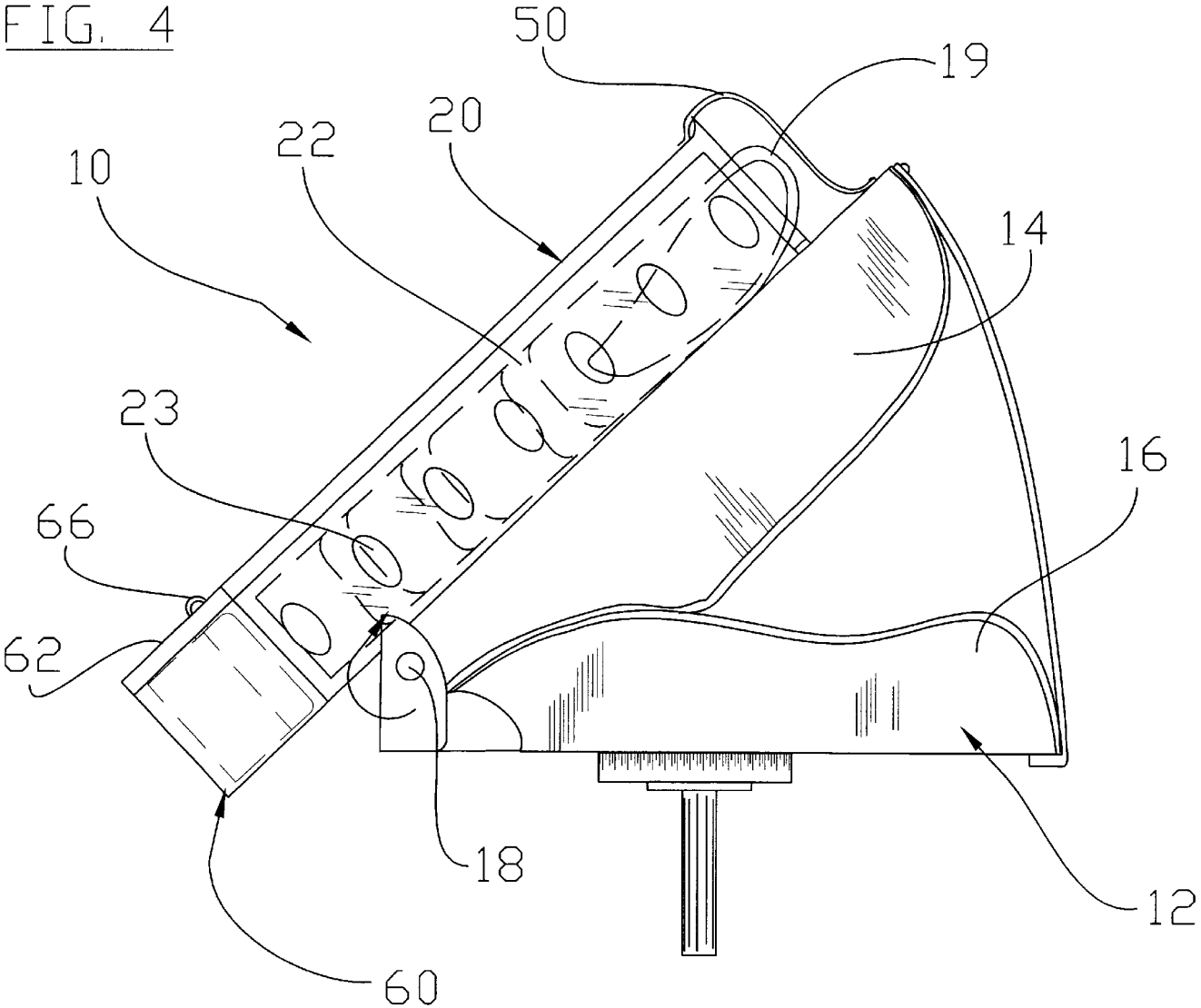
FIG. 4 is a side view of the present invention attached to the back rest of a boat seat in a folded position.

As best shown in FIGS. 1 through 3 of the drawings, the present invention includes an upper storage 20 attachable to the back rest 14 of the boat seat 12 with a lower storage 60 extending downwardly from the upper storage 20. The upper storage 20 is formed for receiving and dispensing a conventional life jacket 19. A securing strap 50 is attached to the upper rim of the upper storage 20 for selectively retaining the life jacket 19 within. The securing strap 50 has a distal end with a first fastener device 52 that mates with a corresponding second fastener device 54 attached to the upper rear portion of the back rest 14 as best illustrated in FIGS. 2, 4, 5 and 7 of the drawings.

As shown in FIGS. 1 through 9 of the drawings, the upper storage 20 is comprised of a tubular structure having a pair of side walls 22, an upper rim securing the upper portion of the side walls 22, and a floor 26 securing the lower portion of the side walls 22 defining a front opening and a rear opening. The upper rim defines an upper opening 24 that allows for the insertion and removal of the conventional life jacket 19. The upper rim is preferably tapered to provide for easy insertion of the life jacket 19 into the upper storage 20. The side walls 22 preferably include a plurality of side openings 23 to provide for increased ventilation of the life jacket 19 contained within the upper storage 20.

Figure 6:
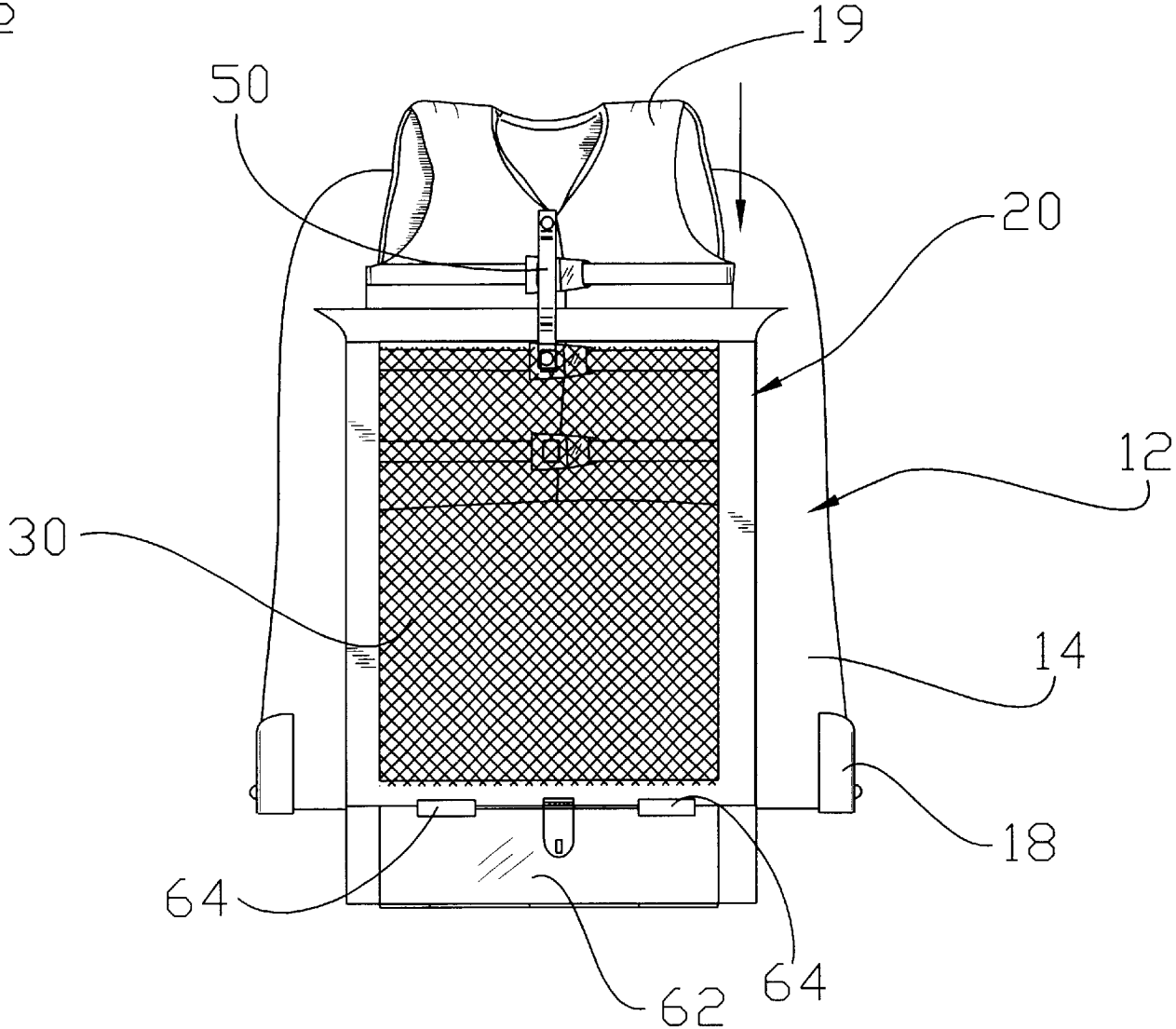
FIG. 6 is a rear view of the present invention attached to a back rest of a boat seat with a life jacket positioned within the upper storage.
Figure 7:
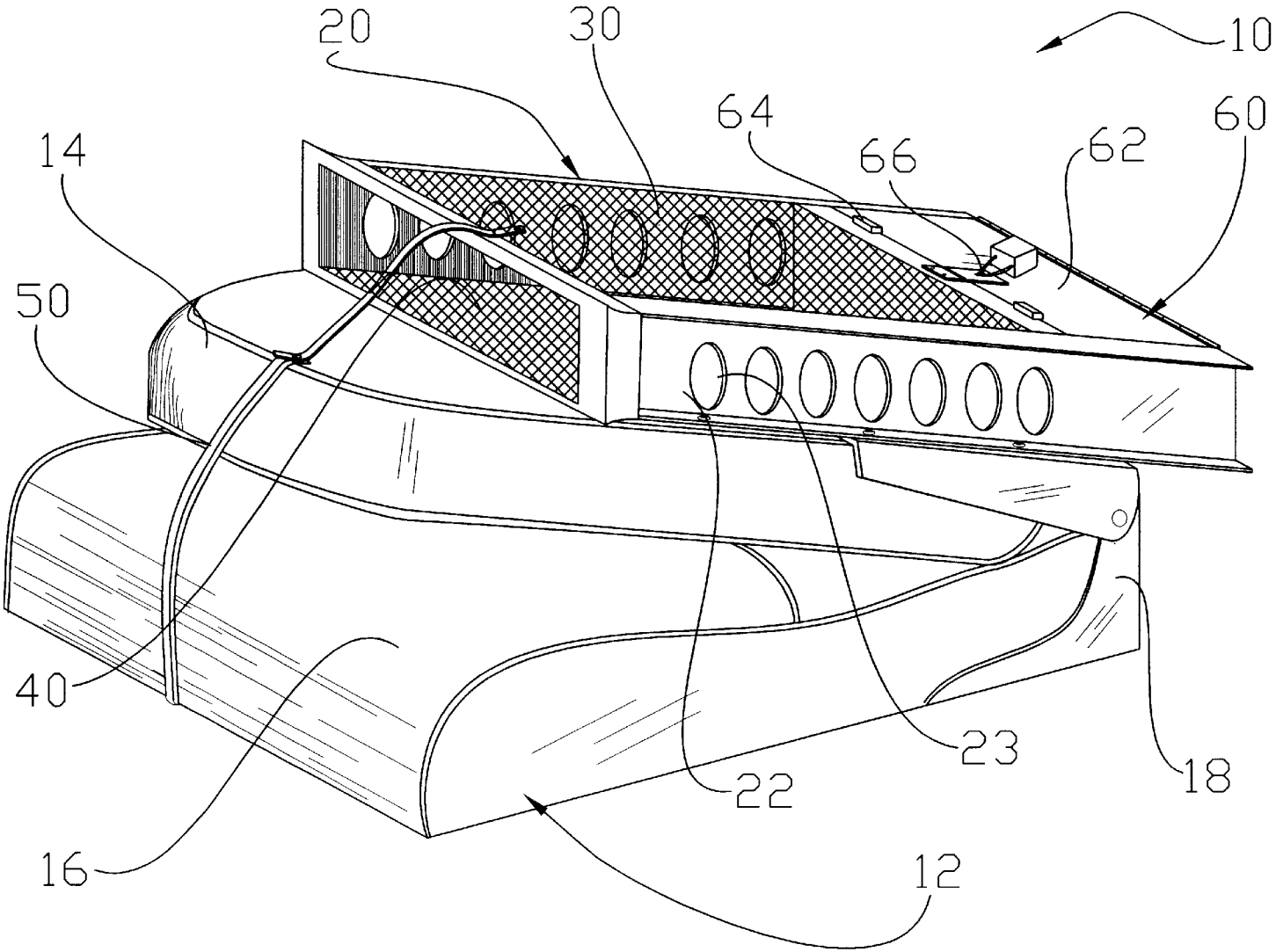
FIG. 7 is an upper perspective view of the present invention attached to the back rest of the boat seat in the folded position.
Figure 8:
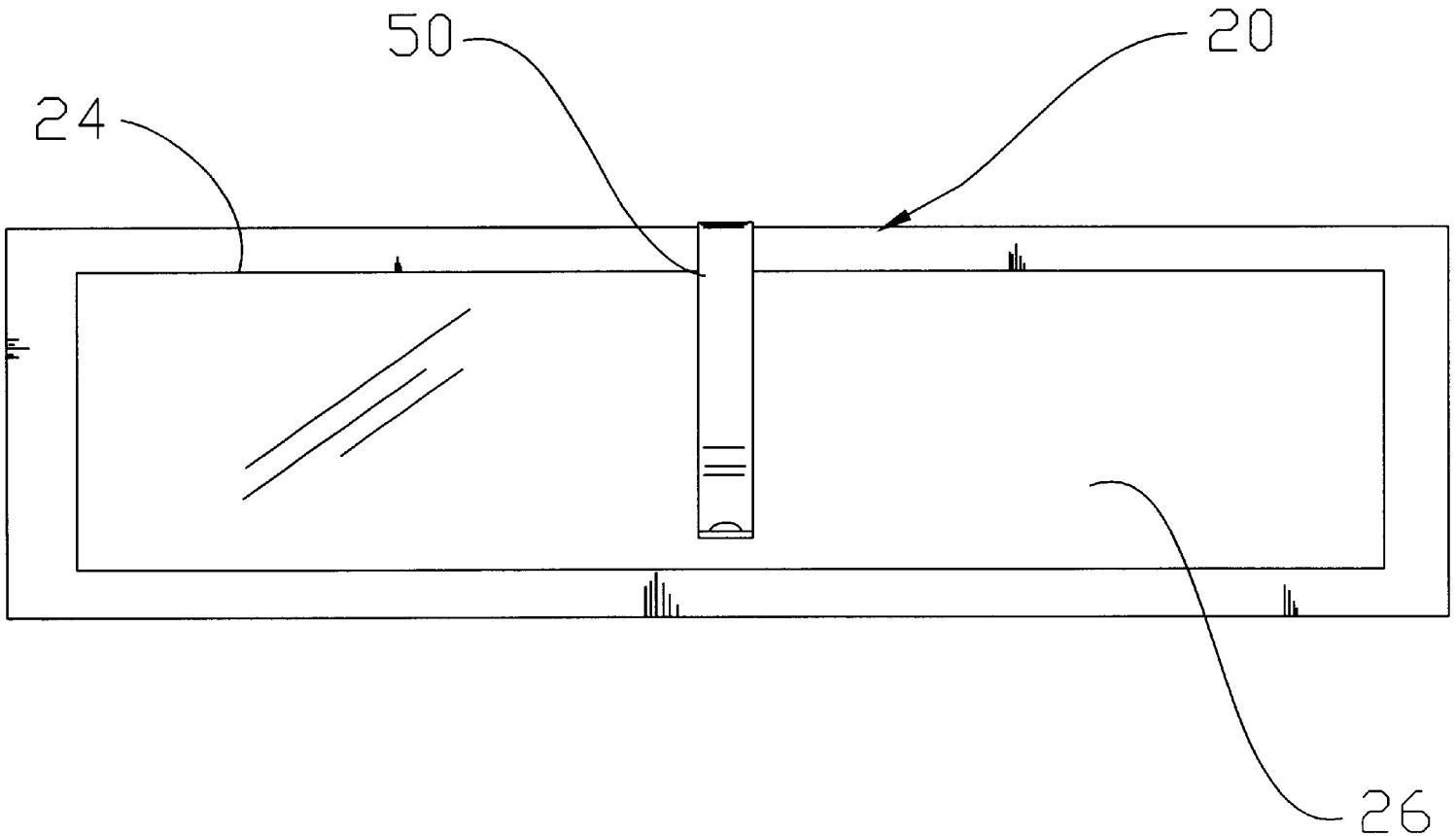
FIG. 8 is a top view of the present invention illustrating the upper opening.

As further shown in FIGS. 1, 6 and 7 of the drawings, a rear webbing 30 is attached between the side walls 22, floor 26 and upper rim to enclose the rear opening of the upper storage 20. The rear webbing 30 may be comprised of any type of material with a plurality of apertures contained within and is preferably resilient to allow for forming to the shape of the life jacket 19 contained within the upper storage 20. The front webbing 40 is preferably similar in structure and function to the rear webbing 30 and is attached about the front opening of the upper storage 20 as best illustrated in FIGS. 1, 7 and 9 of the drawings.

Figure 9:
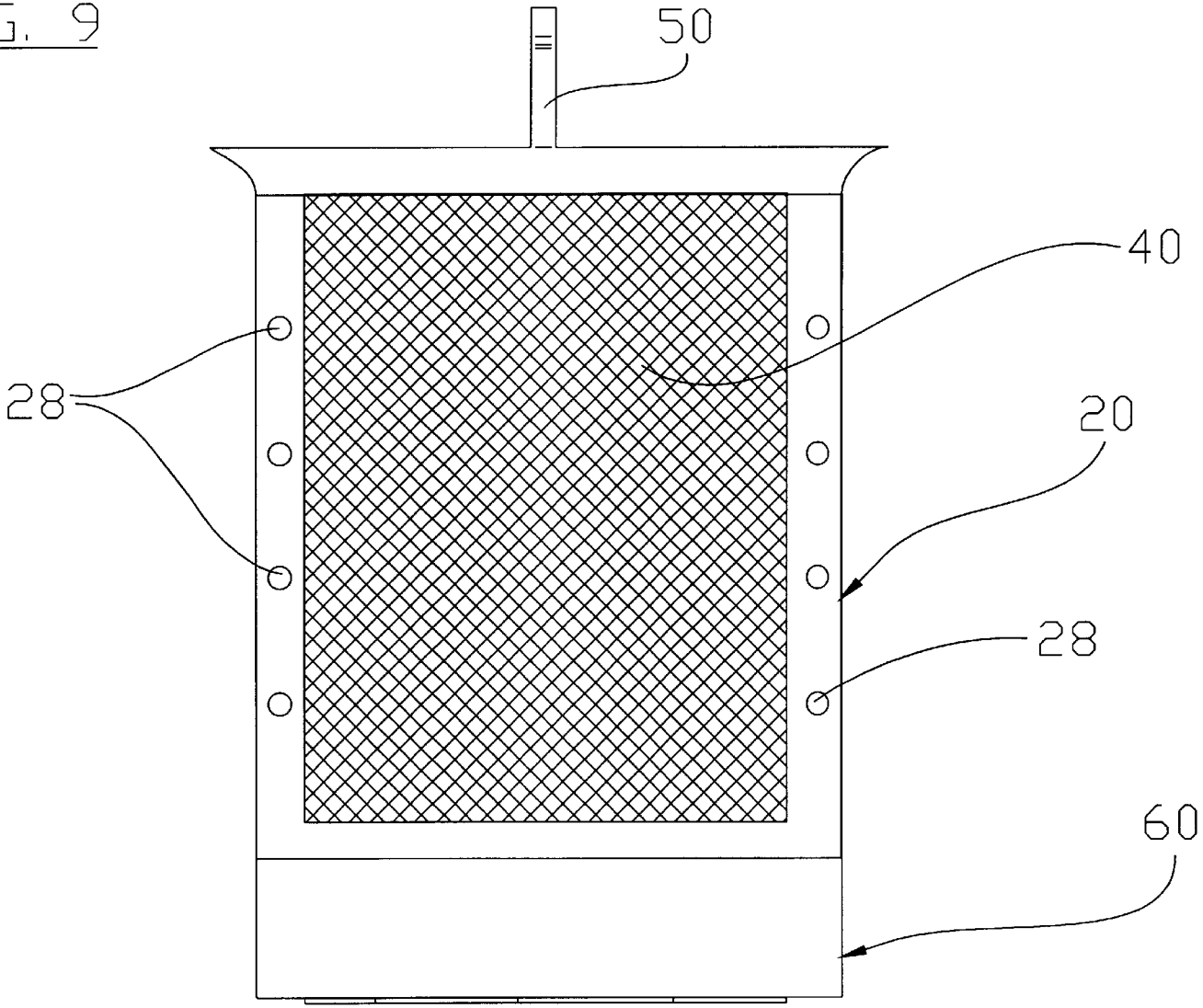
FIG. 9 is a rear view of the present invention.

As best illustrated in FIGS. 1 and 9 of the drawings, the side walls 22 preferably include flanged portions that include a plurality of side apertures 28 that receive a corresponding plurality of fasteners 17. The plurality of fasteners 17 are utilized to secure the upper storage 20 to the back rest 14 of the boat seat 12. Various other attachment means may be utilized to secure the upper storage 20 to the back rest 14 of the boat seat 12 as can be appreciated.

Figure 5:
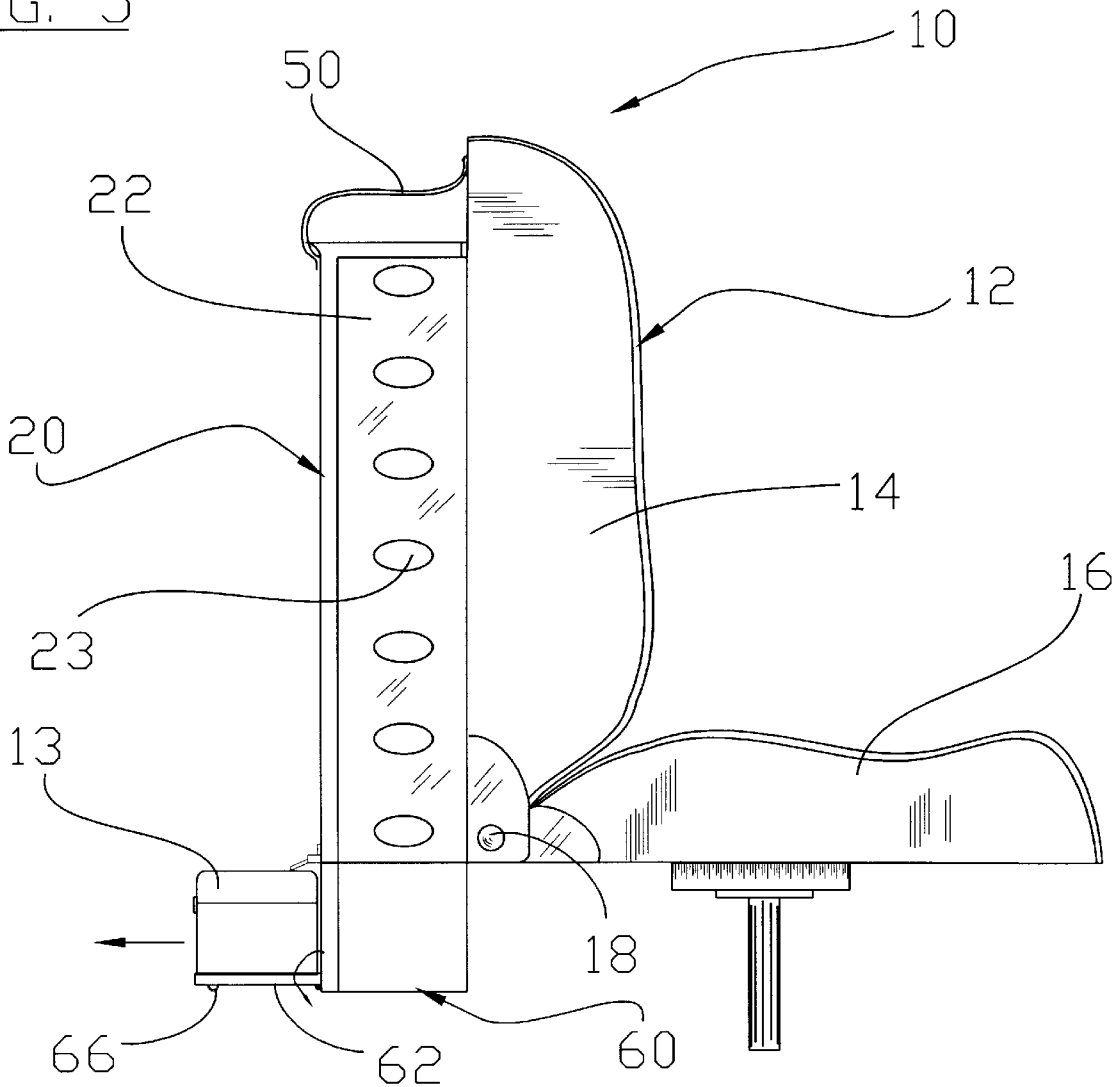
FIG. 5 is a side view of the present invention attached to the boat seat with the tackle box removed from the lower storage.

As shown in FIGS. 1 through 6 of the drawings, a lower storage 60 is attached to the lower end of the upper storage 20. The lower storage 60 preferably includes a pivotally attached door 62 that pivots approximately 90 degrees in a horizontal manner as best illustrated in FIG. 5 of the drawings. A plurality of latches 64 or other structure are utilized to retain the door 62 in a closed position as shown in FIGS. 1 and 7 of the drawings. An eyelet 66 may be attached to the door 62 for receiving a conventional lock 11 with a latch attached to the lower storage 60 for allowing for locking of the door 62 of the lower storage 60.

In use, the user secures the upper storage 20 to the back rest 14 of the boat seat 12 utilizing a plurality of conventional fasteners or other means as shown in FIGS. 2 and 3 of the drawings. The user then positions the life jacket 19 through the upper opening 24 of the upper storage 20 as shown in FIG. 6 of the drawings. The user then secures the securing strap 50 to the back rest 14 of the boat seat 12 when the life jacket 19 is properly positioned within the upper storage 20. The rear webbing 30 and front webbing 40 conform to and snugly receive the life jacket 19 regardless of the shape or size of the life jacket 19. The user then inserts the tackle box 13 within the lower storage 60 and secures the door 62 with the latches 64. When the user desires to access fishing tackle or other items within the lower storage 60, the user then opens the door 62 in a horizontal manner and removes the tackle box 13 from within the lower storage 60 as shown in FIG. 5 of the drawings. When finished with the tackle box 13, the user simply repositions the tackle box 13 within the lower storage 60 and secures the door 62 of the lower storage 60. If the user requires usage of the life jacket 19 within the upper storage 20, the user simply removes the securing strap 50 from the back rest 14 of the seat 12 and then removes the life jacket 19 through the upper opening 24 of the upper storage 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A boat seat system for storing a life jacket, comprising:

an upper storage attachable to a back rest of a boat seat by a plurality of fasteners;

an upper opening within said upper storage for receiving said life jacket;

at least one securing strap attached to an upper portion of said upper storage having a first fastener device that selectively mates with a corresponding second fastener device attachable to said back rest of said boat seat, wherein said first fastener device is attached to a distal end of said securing strap and wherein said at least one securing strap is comprised of one securing strap attached to a center upper portion of said upper storage; and wherein said upper storage is comprised of a pair of side walls, an upper rim having said upper opening extending between upper portions of said side walls, a floor extending between lower portions of said side walls defining a front opening and a rear opening within said upper storage, and a rear webbing attached to said upper storage about said rear opening.

2. The boat seat system of claim 1, including a front webbing attached to said upper storage about said front opening.

3. The boat seat system of claim 2, wherein said rear webbing and said front webbing are comprised of a resilient material.

4. The boat seat system of claim 1, wherein said upper storage has a rectangular shape.

5. The boat seat system of claim 1, wherein said pair of side walls each include an extended flange portion having a plurality of side apertures for receiving said plurality of fasteners.

6. The boat seat system of claim 1, wherein each of said pair of side walls includes plurality of side openings.

7. A boat seat system for storing a life jacket, comprising:

an upper storage attachable to a back rest of a boat seat by a plurality of fasteners;

an upper opening within said upper storage for receiving said life jacket;

a lower storage attached to a lower end of said upper storage for receiving a tackle box;

a door pivotally attached to a lower edge of said lower storage;

at least one latch attached to said lower storage for securing said door in a closed position;

at least one securing strap attached to an upper portion of said upper storage having a first fastener device that selectively mates with a corresponding second fastener device attachable to said back rest of said boat seat, wherein said first fastener device is attached to a distal end of said securing strap and wherein said at least one securing strap is comprised of one securing strap attached to a center upper portion of said upper storage; and wherein said upper storage is comprised of a pair of side walls, and upper rim having said upper opening extending between upper portions of said side walls, a floor extending between lower portions of said side walls defining a front opening and a rear opening within said upper storage, and a rear webbing attached to said upper storage about said rear opening.

8. The boat seat system of claim 7, including a front webbing attached to said upper storage about said front opening.

9. The boat seat system of claim 8, wherein said rear webbing and said front webbing are comprised of a resilient material.

10. The boat seat system of claim 7, wherein said upper storage has a rectangular shape.

11. The boat seat system of claim 7, wherein said pair of side walls each include an extended flange portion having a plurality of side apertures for receiving said plurality of fasteners.

12. The boat seat system of claim 7, wherein each of said pair of side walls includes a plurality of side openings.

13. A boat seat system for storing a life jacket, comprising:

an upper storage having a rectangular shape attachable to a back rest of a boat seat, wherein said upper storage is comprised of a pair of side walls, an upper rim defining an upper opening extending between upper portions of said side walls, a floor extending between lower portions of said side walls defining a front opening and a rear opening within said upper storage, and a rear webbing attached to said upper storage about said rear opening wherein said rear webbing and said front webbing are comprised of a resilient material;

a securing strap attached to an upper portion of said upper storage having a first fastener device that selectively mates with a corresponding second fastener device, wherein said first fastener device is attached to a distal end of said securing strap; and a front webbing to said upper storage about said front opening;

wherein said pair of side walls each include an extended flange portion having a plurality of side apertures for receiving said plurality of fasteners.

14. The boat system of claim 13, wherein each of said pair of side walls includes a plurality of side openings.

* * * * *